US010019968B2

(12) United States Patent
Bi et al.

(10) Patent No.: US 10,019,968 B2
(45) Date of Patent: Jul. 10, 2018

(54) VARIABLE REFRESH RATE DISPLAY SYNCHRONIZATION

(71) Applicant: Apple Inc., Cupertino, CA (US)

(72) Inventors: Yafei Bi, Palo Alto, CA (US); Arthur L. Spence, Cupertino, CA (US); Vanessa C. Heppolette, Cupertino, CA (US); Eran Tamari, Herzeliya Pituach (IL); Josh P. DeCesare, Campbell, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/271,085

(22) Filed: Sep. 20, 2016

(65) Prior Publication Data

US 2017/0193971 A1 Jul. 6, 2017

Related U.S. Application Data

(60) Provisional application No. 62/273,945, filed on Dec. 31, 2015.

(51) Int. Cl.

| | |
|---|---|
| ***G09G 5/12*** | (2006.01) |
| ***G09G 5/18*** | (2006.01) |
| ***G09G 5/395*** | (2006.01) |
| ***G09G 5/39*** | (2006.01) |
| ***G09G 5/00*** | (2006.01) |
| ***G09G 5/393*** | (2006.01) |

(52) U.S. Cl.

CPC ..... *G09G 5/39* (2013.01); *G09G 5/001* (2013.01); *G09G 5/12* (2013.01); *G09G 5/18* (2013.01); *G09G 5/393* (2013.01); *G09G 5/395* (2013.01); *G09G 2310/04* (2013.01); *G09G 2340/0435* (2013.01); *G09G 2360/18* (2013.01)

(58) Field of Classification Search

None

See application file for complete search history.

(56) References Cited

U.S. PATENT DOCUMENTS

| | | | | |
|---|---|---|---|---|
| 5,451,981 | A * | 9/1995 | Drako | G09G 5/393 345/545 |
| 8,928,639 | B2 * | 1/2015 | Lee | G06F 13/14 345/204 |
| 9,653,045 | B2 * | 5/2017 | Asai | G09G 5/39 |
| 9,754,521 | B2 * | 9/2017 | Ryu | G09G 3/20 |
| 2011/0057965 | A1 * | 3/2011 | Park | G09G 3/003 345/690 |

(Continued)

*Primary Examiner* — Joni Richer

(74) *Attorney, Agent, or Firm* — Fletcher Yoder PC

(57) ABSTRACT

Systems and methods for synchronizing a video source and display circuitry using a dynamic tearing effect (TE) signal are provided. In one embodiment, an electronic display device includes: variable refresh rate circuitry that, when no new frame data is provided to the electronic display device, extends a vertical blanking period and reduces a refresh rate of the electronic display device. A tearing effect signal is generated, which is selectively set to a first logical level at a first period of time and a second logical level at a second period of time. The tearing effect signal is provided to the host electronic device that provides frame data to the electronic display device and upon receipt of new frame data, an un-extended vertical blanking period is returned to and the frame data at the next frame boundary is displayed.

20 Claims, 10 Drawing Sheets

(56) References Cited

U.S. PATENT DOCUMENTS

2013/0082910 A1* 4/2013 Lee ..... G09G 3/3208
345/76
2016/0196801 A1* 7/2016 Glen ..... G09G 5/18
345/213

* cited by examiner

VARIABLE REFRESH RATE DISPLAY SYNCHRONIZATION

CROSS-REFERENCE TO RELATED APPLICATIONS

This application claims the benefit of Provisional Application Ser. No. 62/273,945, filed Dec. 31, 2015, entitled "Variable Refresh Rate Display Synchronization," which is incorporated by reference herein in its entirety.

BACKGROUND

The present disclosure relates generally to synchronizing a video source (e.g., a system on chip (SOC)) and display circuitry. More particularly, the disclosure relates to synchronizing the video source and display circuitry using a dynamic tearing effect (TE) signal.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A wide variety of electronic devices include some form of electronic display. Such devices include cellular telephones, tablet computers, laptop computers, personal computers, televisions, headphones, Bluetooth® enabled watches, printers, and cameras, just to name a few. To display images, a video source of the electronic device provides a frame of image data to the electronic display, where the image data is stored in a memory device known as a "frame buffer." The electronic display reads the image data out of the frame buffer and causes the image data to be represented on the display. At any time, the electronic display reads only one frame of image data from the frame buffer. That is, since one frame of image data may differ from the next, reading part of a first frame and part of a second frame onto the electronic display at the same time could produce what is known as a "tearing effect," with part of the electronic display showing the first frame and part of the electronic display showing the second frame.

To avoid the tearing effect, the electronic display may emit a tearing effect (TE) signal in a pulse that indicates to the video source when the video source may provide the image data to the electronic display to be saved into the frame buffer. Specifically, the electronic display may emit the TE signal pulse at a time when the electronic display is not reading out of the frame buffer. In this way, only one frame of image data will be stored in the frame buffer during any readout of the image data by the display. This pulsed form of synchronization between the video source and the electronic display may rely on a static refresh rate, but this may preclude the use of a variable refresh rate.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The systems and methods described herein provide new methods of synchronization between a video source display data provider and display circuitry. For example, the display circuitry may provide a tearing effect (TE) signal that affects when the video source may provide display data to the display circuitry in a way that facilitates variable refresh rates. For example, the display circuitry may provide the TE signal dynamically between a LOW and HIGH state to avoid the tearing effect while accommodating variable refresh rates. The state of the TE signal may be switched, for instance, based upon a variable vertical blanking period, resulting in reduced latency of frame writing from the SOC to the display circuitry.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Variable refresh rate (VRR) display circuitry enables a display to refresh the display panel at variable rates. For example, VRR display circuitry may be able to refresh a display panel at 240 Hz, 60 Hz, and/or 1 Hz. For instance, when fewer panel refreshes are needed, the VRR display circuitry may reduce the refresh rate from a higher refresh rate to a lower refresh rate. Such reduction in refresh rate may result in certain display circuitry efficiencies, such as display circuitry power conservation, etc.

However, these variable refresh rates may result in a complex synchronization between a display data source and the VRR display circuitry. For instance, VRR display circuitry may utilize extended vertical blanking periods. During these extended periods, a new frame of image data may be written to a frame buffer of the VRR display circuitry without risk of the tearing effect. However, the display data source may be unaware of the extended vertical blanking period in a timely manner, which may result in latency of writing to the display panel from the display data source.

The techniques described herein provide an indication of variable refresh rate modes implemented in VRR display circuitry. This indication may be used to synchronize data writing from the display data source with the vertical blanking and/or data reading of the VRR display circuitry.

Figure 1:
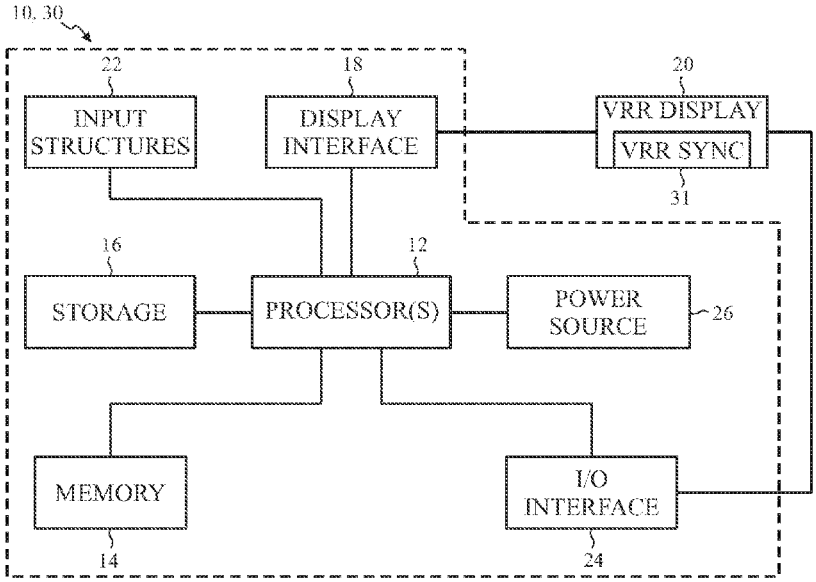
FIG. 1 is a schematic block diagram of an electronic device including variable refresh rate display circuitry, in accordance with an embodiment.

With these features in mind, a general description of suitable electronic devices is provided that may implement and/or use synchronization of variable refresh rate (VRR) display panels via a tearing effect (TE) signal. Turning first to FIG. 1, an electronic device 10 according to an embodiment of the present disclosure may include, among other things, one or more processor(s) 12, memory 14, nonvolatile storage 16, a display interface 18, a display 20 (which may be a separate device in some embodiments), input structures 22, an input/output (I/O) interface 24 and a power source 26. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

The electronic device 10 (or a subset of the components of the electronic device 10) may act as a host device 30 that sources video data to the display 20. For example, components of the electronic device 10 may be part of a system on chip (SOC) that provides display data to the display 20 (e.g., via the display interface 18 (e.g., a High-Definition Multimedia Interface (HDMI) port, Mobile Industry Processor Interface (MIPI), and/or a Universal Serial Bus (USB) port, such as a USB Type C port).

The display 20 may be a variable refresh rate (VRR) display that is capable of operating at variable refresh rates. Accordingly, to synchronize data provision from the host 30 to the display 20, the display 20 may include VRR synchronization logic 31 (e.g., hardware circuitry) that may provide an indication of refresh rates implemented in operation of the display 20. The host 30 may use this indication to determine when display data may be provided to the display 20.

Figure 2:
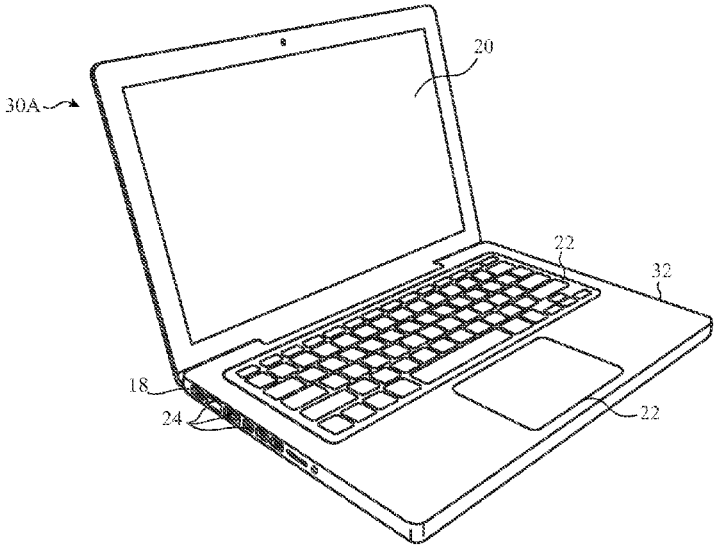
FIG. 2 is a perspective view of a notebook computer representing an embodiment of the electronic device of FIG. 1, in accordance with an embodiment.
Figure 3:
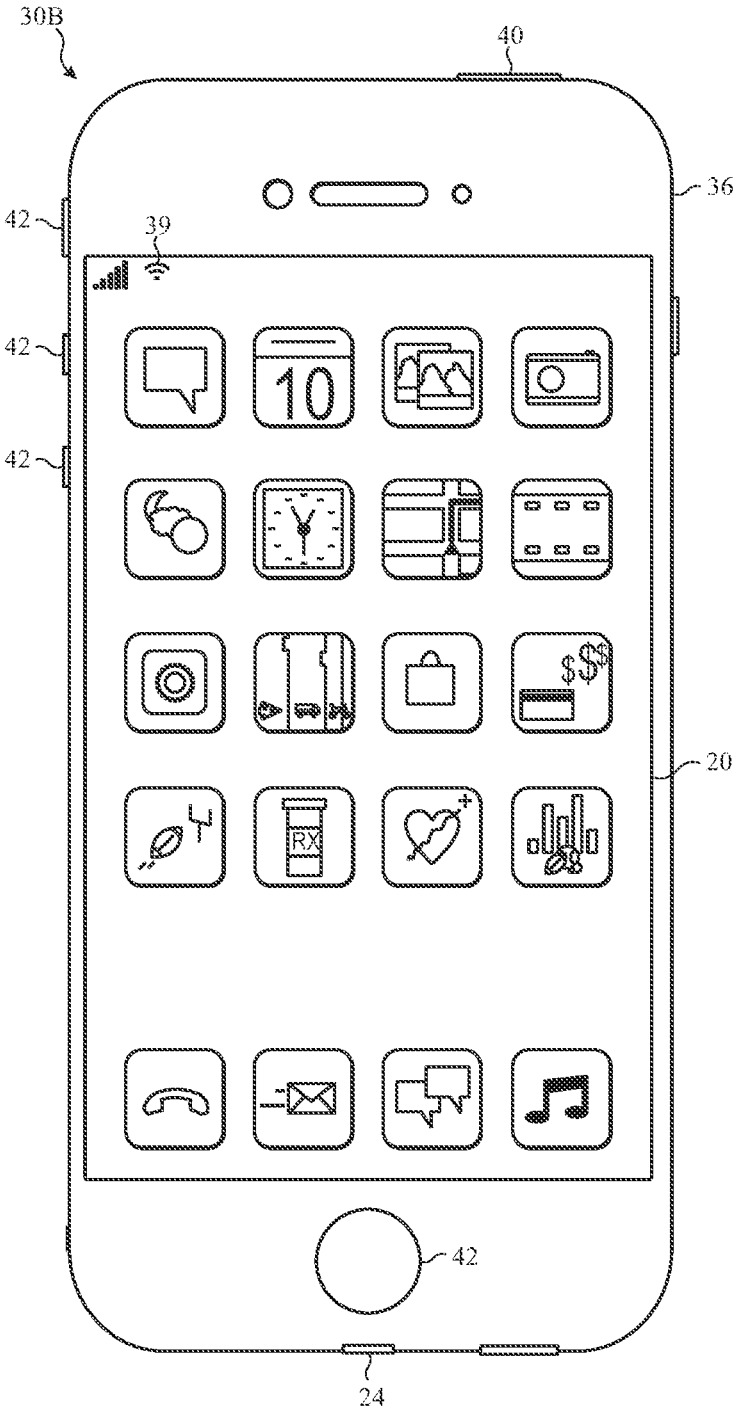
FIG. 3 is a front view of a hand-held device representing another embodiment of the electronic device of FIG. 1, in accordance with an embodiment.
Figure 4:
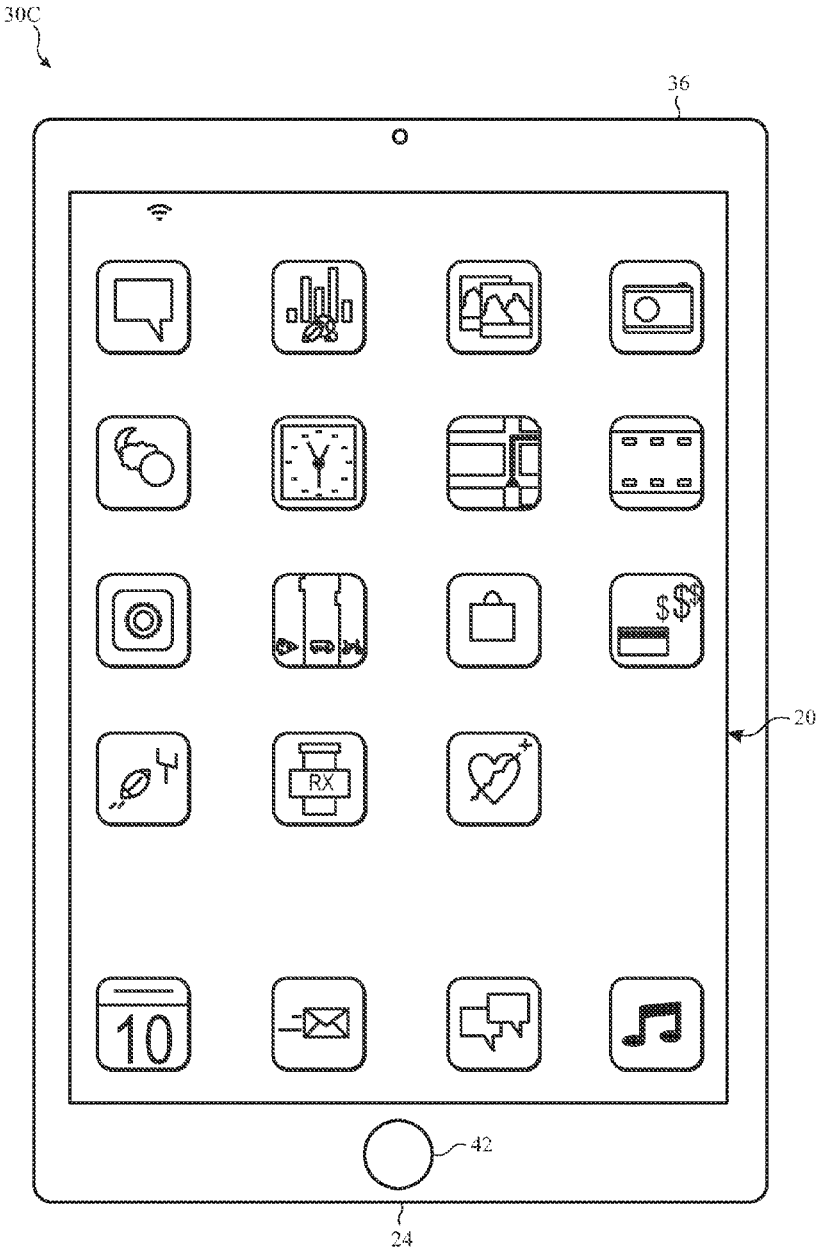
FIG. 4 is a front view of another hand-held device representing another embodiment of the electronic device of FIG. 1, in accordance with an embodiment.
Figure 5:
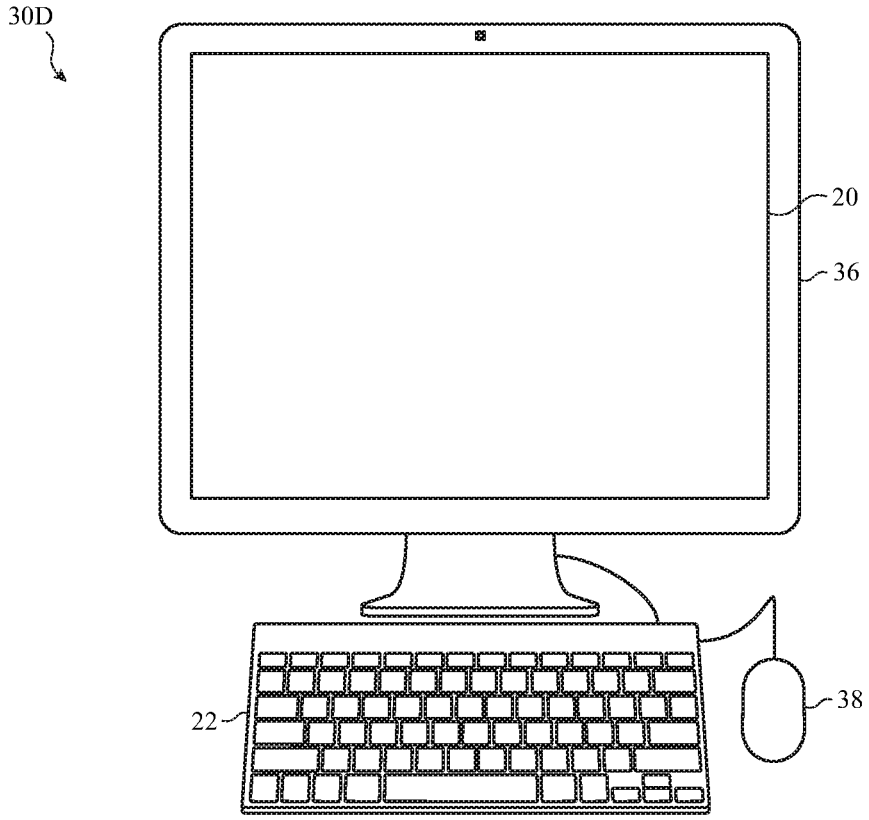
FIG. 5 is a front view of a desktop computer representing another embodiment of the electronic device of FIG. 1, in accordance with an embodiment.
Figure 6:
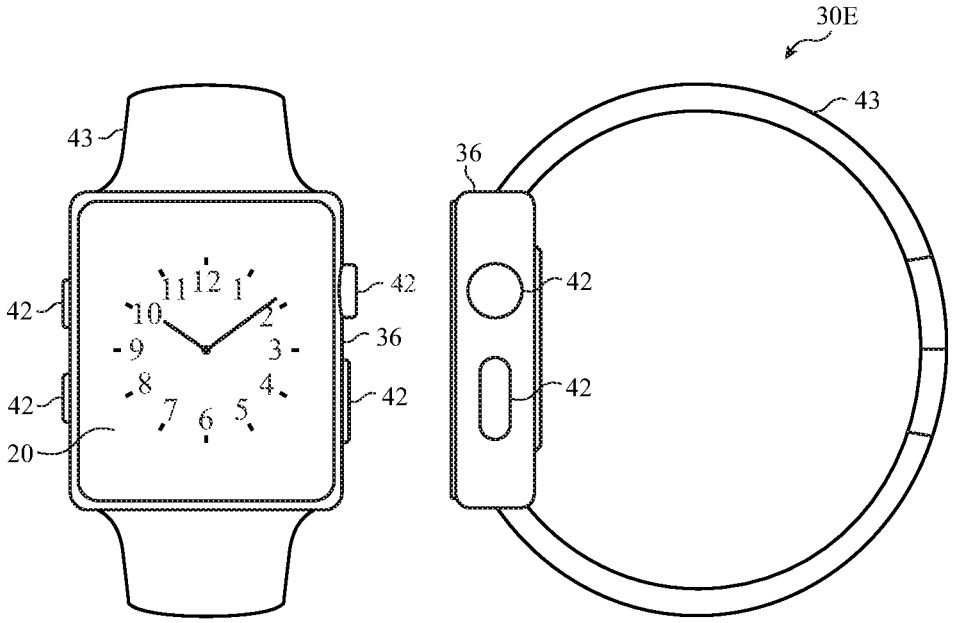
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile memory 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., e.g., an operating system) encoded on such a computer program product may also include instructions that may be executed by the processor(s) 12 to enable the electronic device 10 to provide various functionalities.

In certain embodiments, the display 20 may be a liquid crystal display (e.g., LCD), which may allow users to view images generated on the electronic device 10. In some embodiments, the display 20 may include a touch screen, which may allow users to interact with a user interface of the electronic device 10. Furthermore, it should be appreciated that, in some embodiments, the display 20 may include one or more light emitting diode (e.g., LED, OLED, AMOLED, etc.) displays, or some combination of LCD panels and LED panels.

The input structures 22 of the electronic device 10 may enable a user to interact with the electronic device 10 (e.g., e.g., pressing a button to increase or decrease a volume level). The I/O interface 24 may enable electronic device 10 to interface with various other electronic devices. The I/O interface 24 may include various types of ports that may be connected to cabling. These ports may include standardized and/or proprietary ports, such as USB, RS232, Apple's Lightning® connector, as well as one or more ports for a conducted RF link. The I/O interface 24 may also include, for example, interfaces for a personal area network (e.g., PAN), such as a Bluetooth network, for a local area network (e.g., LAN) or wireless local area network (e.g., WLAN), such as an 802.11x Wi-Fi network, and/or for a wide area network (e.g., WAN), such as a 3rd generation (e.g., 3G) cellular network, 4th generation (e.g., 4G) cellular network, or long term evolution (e.g., LTE) cellular network. The I/O interface 24 may also include interfaces for, for example, broadband fixed wireless access networks (e.g., WiMAX), mobile broadband Wireless networks (e.g., mobile WiMAX), and so forth.

As further illustrated, the electronic device 10 may include a power source 26. The power source 26 may include any suitable source of power, such as a rechargeable lithium polymer (e.g., Li-poly) battery and/or an alternating current (e.g., AC) power converter. The power source 26 may be removable, such as replaceable battery cell.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include housing or enclosure 32, a display 20, input structures 22, and ports of the I/O interface 24. In one embodiment, the input structures 22 (e.g., such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 20.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 30B may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 20, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a connector and protocol, such as the Lightning connector provided by Apple Inc., a universal service bus (e.g., USB), one or more conducted RF connectors, or other connectors and protocols.

User input structures 40 and 42, in combination with the display 20, may allow a user to control the handheld device 30B. For example, the input structure 40 may activate or deactivate the handheld device 30B, one of the input structures 42 may navigate user interface to a home screen, a user-configurable application screen, and/or activate a voice-recognition feature of the handheld device 30B, while other of the input structures 42 may provide volume control, or may toggle between vibrate and ring modes. Additional input structures 42 may also include a microphone may obtain a user's voice for various voice-related features, and a speaker to allow for audio playback and/or certain phone capabilities. The input structures 42 may also include a headphone input to provide a connection to external speakers and/or headphones.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may take any suitable form of computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (e.g., PC) by another manufacturer. A similar enclosure 36 may be provided to protect and enclose internal components of the computer 30D such as the dual-layer display 20. In certain embodiments, a user of the computer 30D may interact with the computer 30D using various peripheral input devices, such as the keyboard 22 or mouse 38, which may connect to the computer 30D via a wired and/or wireless I/O interface 24.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., e.g., pedometer, accelerometer, heart rate monitor), or other device by another manufacturer. The display 20 of the wearable electronic device 30E may include a touch screen (e.g., e.g., LCD, OLED display, active-matrix organic light emitting diode (e.g., AMOLED) display, and so forth), which may allow users to interact with a user interface of the wearable electronic device 30E.

Figure 7:
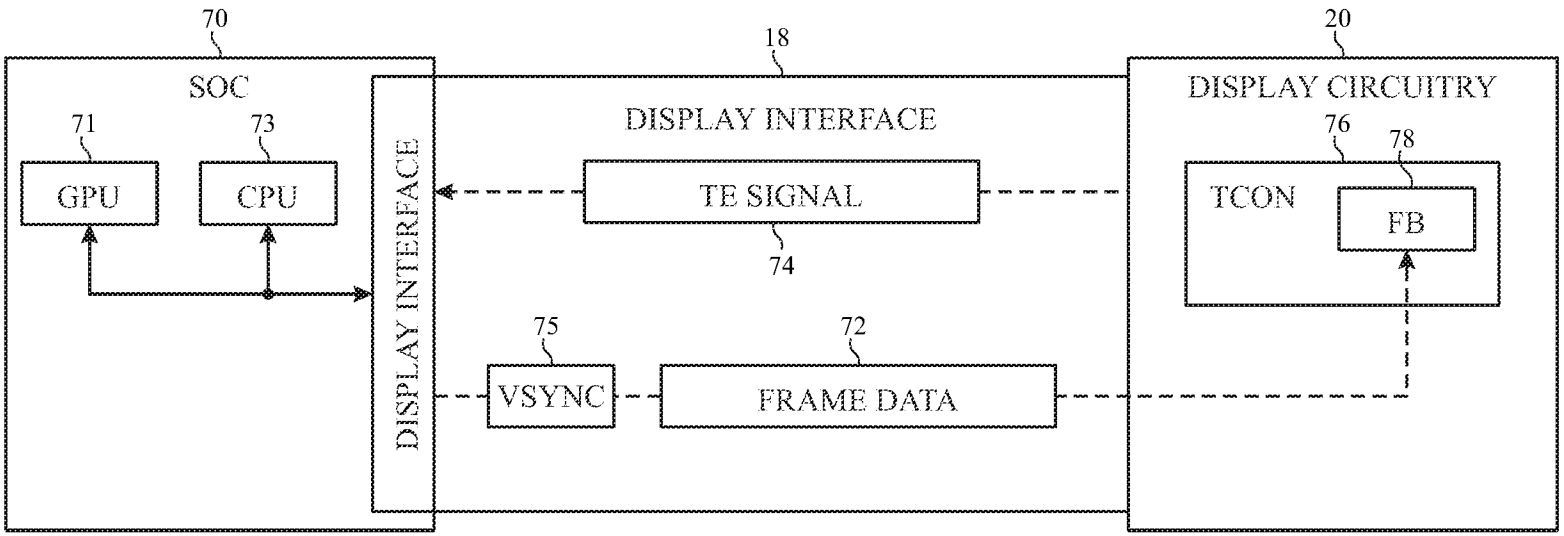
FIG. 7 is a diagram illustrating system on chip (SOC) data provision to a variable refresh rate (VRR) display, where a tearing effect (TE) signal is provided for synchronization of the SOC and the VRR display, in accordance with an embodiment.

To ensure that data writing and reading operations do not conflict with each other, the timings of the display data source (e.g., host 30) and the display 20 may be synchronized. FIG. 7 is a diagram illustrating provision of frame data 72, from a system on chip (SOC) 70, to a variable refresh rate (VRR) display 20. Although the current discussion references an SOC, the systems of methods described herein may be used in any data processing circuitry. The SOC 70 may include a graphics processing unit (GPU) 71 for the creation of images (e.g. frame data 72) in a frame buffer that is intended for output to the display 20. Further, the SOC 70 may include a central processing unit (CPU), which may be used to provide computer-understandable instructions to the display 20 circuitry.

The synchronization between the SOC 70 and the display 20 circuitry may be facilitated by a tearing effect (TE) signal 74 (or other signal) provided by the display 20 (e.g., via a timing controller (TCON) 76) to the SOC 70. As will be discussed in more detail below, the TE signal 74 (or other signal) may be set based upon vertical blanking periods of the display 20.

Based upon the received TE signal 74, the SOC 70 may provide frame data 72 to the display 20 (e.g., to a frame buffer 78). Furthermore, the SOC 70 may provide a synchronization signal (e.g., VSYNC 75) to the display 20 to cause the display 20 to refresh frame data 72 stored in pixels of the display 20. As may be appreciated, one or more of the frame data 72, the synchronization signal, and a mode signal may be provided from the SOC 70 to the display 20 via the interface 18 (e.g., a communication link (e.g., via a mobile industry processor interface (MIPI))).

Figure 8:
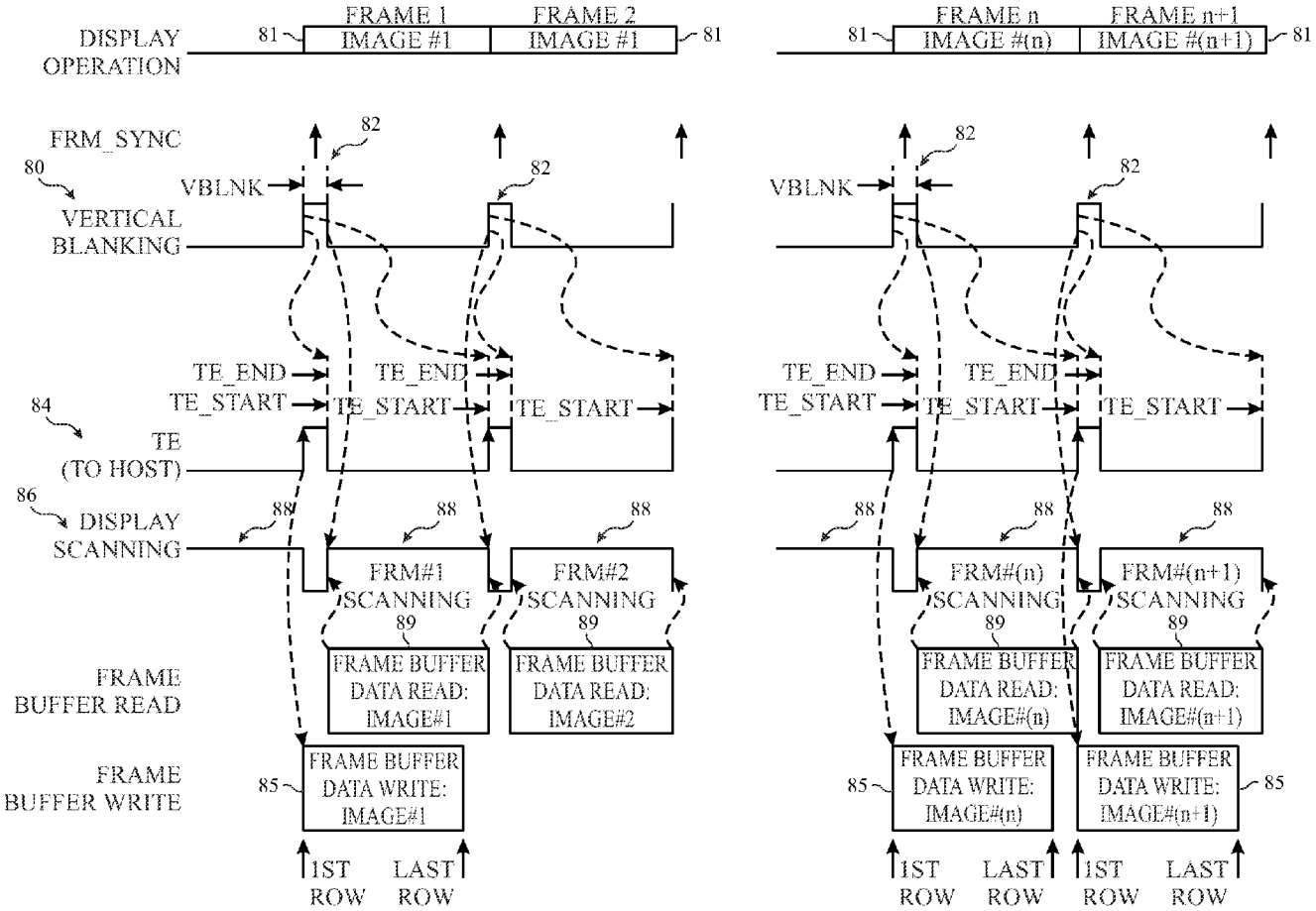
FIG. 8 is a diagram illustrating display data writing and reading synchronized via the TE signal, in accordance with an embodiment.
Figure 9:
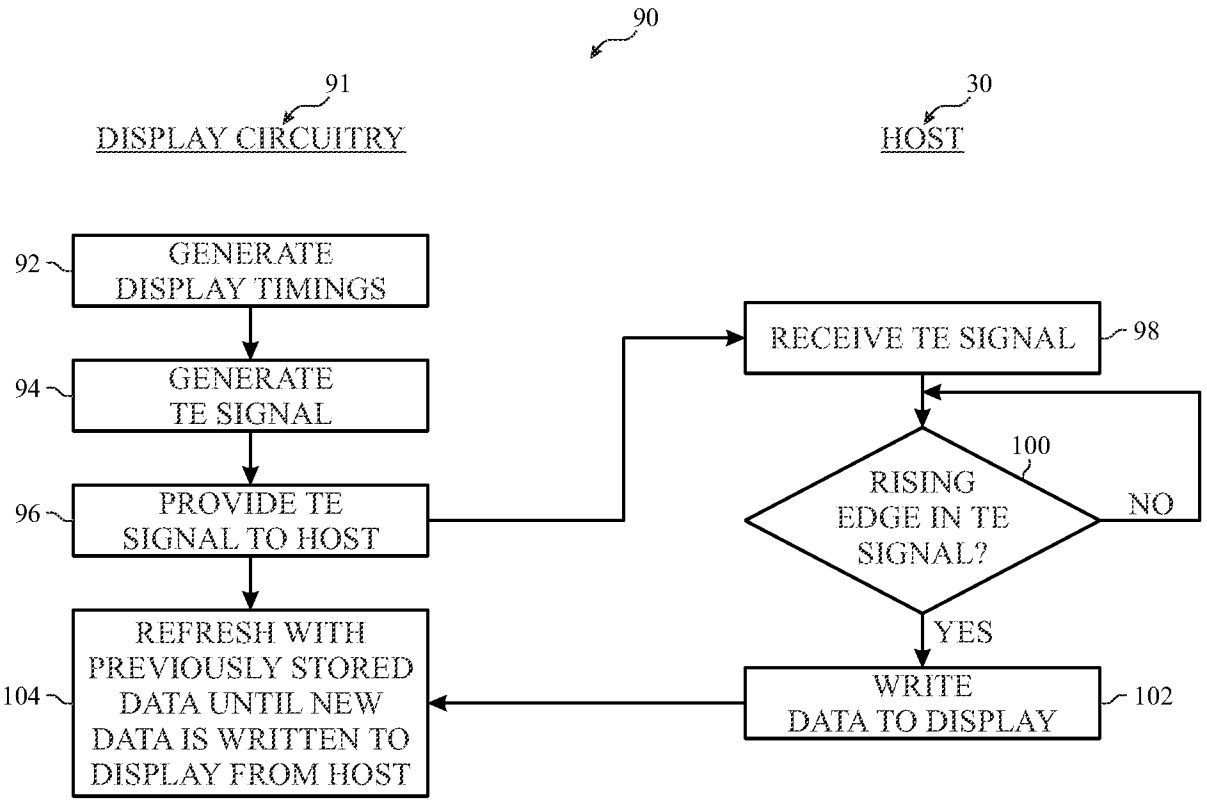
FIG. 9 is a flowchart illustrating a process for implementing the data reads and/or writes of FIG. 8, in accordance with an embodiment.

Having discussed the basic relationship between the SOC and the display 20, FIG. 8 is a diagram illustrating display data writing operations and reading operations for a fixed frame rate mode of the display 20, where the operations are synchronized via the TE signal 74. These operations result in the presentation of display frames 81. FIG. 9 is a flowchart illustrating a process 90 for implementing the data reads and/or writes of FIG. 8. For example, FIG. 8 illustrates n+1 frames of a display 20. For clarity, these figures will be discussed jointly.

The process 90 begins with circuitry of the display 20 generating display timings for the operation of the display 20 (block 92). For example, as illustrated in FIG. 8, a vertical blanking signal 80 may provide periodic vertical blanking periods 82, denoted by the vertical blanking signal 80 being set to a HIGH state.

Circuitry of the display 20 may then generate a tearing effect (TE) signal 84, or other signal, that provides an indication of the generated display timings of block 92 (block 94). For example, the TE signal 84 may mirror the vertical blanking signal 80. Alternatively, the rising edges and/or falling edges of the TE signal 84 may either lag or lead corresponding rising edges and/or falling edges of the vertical blanking signal 80.

Once the TE signal 84 is generated, the TE signal 84 may be provided from the circuitry of the display 20 to the host 30 (e.g., SOC 70 of FIG. 7) (block 96). For example, the TE signal 84 may be provided via the display interface 18 of FIG. 1 (e.g., via a MIPI interface, etc.).

The TE signal 84 may then be received by the host 30 (block 98). Data provision by the host 30 may be triggered by the TE signal 84. Accordingly, the host 30 may detect when a rising edge of the TE signal 84 is present (decision block 100).

The host 30 may initiate data write operations 85 to the display 20 circuitry at timings associated with a rising edge that is detected in the TE signal 84 (block 102). Otherwise, the host 30 will not initiate data write operations, but will continue to poll for timings associated with detected rising edges.

When the display is a fixed refresh rate display 20, the display 20 will continually refresh at a fixed rate. Accordingly, when new data is not written to the display 20, the panel is refreshed with previously written data. However, when new data is written to the display 20, the newly written data is used to refresh the panel (block 104). For example, the display scanning timing 86 illustrates rising edges at the start of display 20 frame scanning periods 88 (e.g., 60 Hz scanning periods). During these scanning periods, display data read operations 88 are implemented by the display 20.

Figure 10:
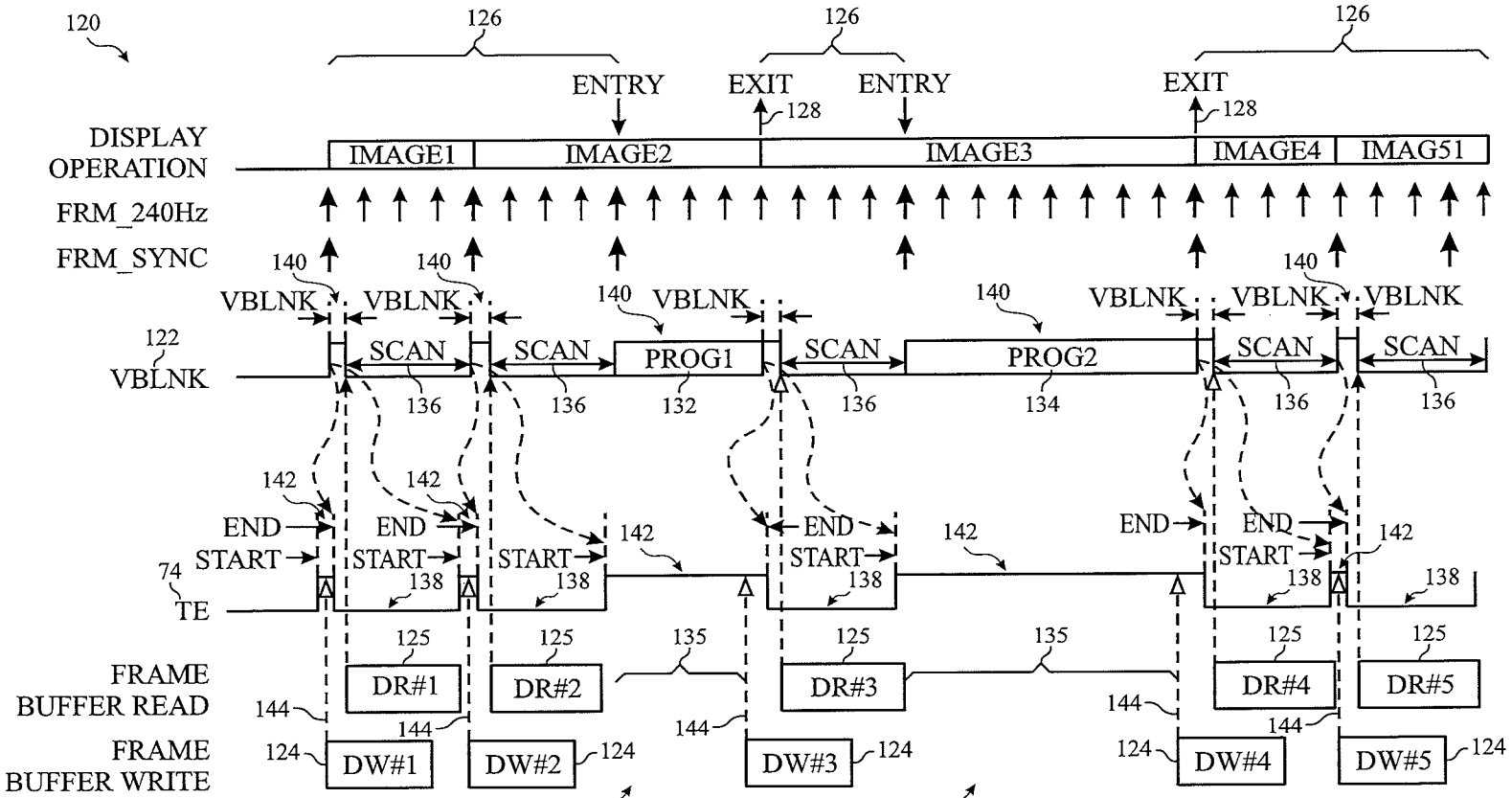
FIG. 10 is a diagram illustrating display data writing and reading of VRR display circuitry via the TE signal, in accordance with an embodiment.
Figure 11:
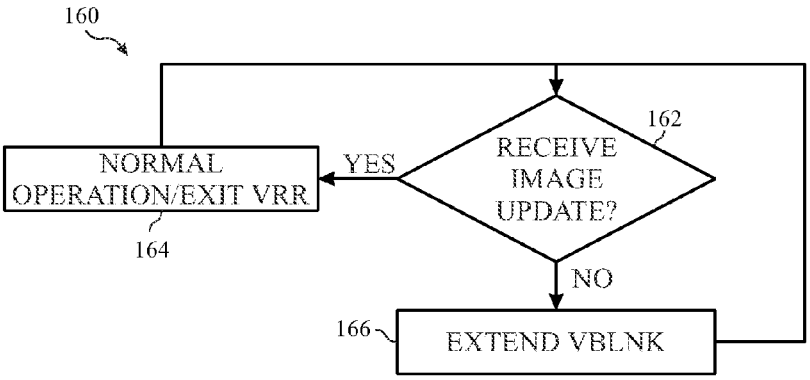
FIG. 11 is a flowchart illustrating a process for implementing the variable refresh rate of FIG. 10, in accordance with an embodiment.
Figure 12:
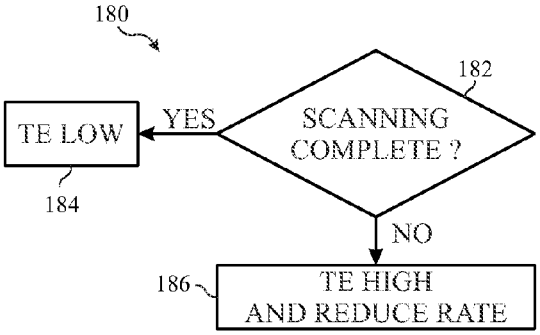
FIG. 12 is a flow chart illustrating a process for generating a variable refresh rate tearing effect signal, in accordance with an embodiment.
Figure 13:
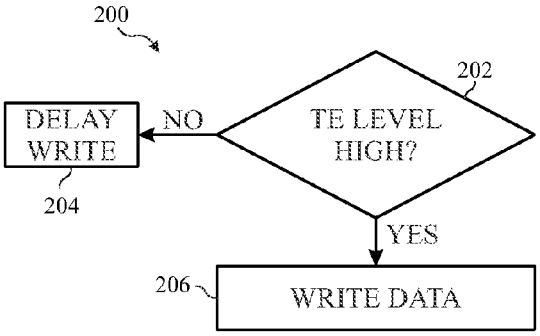
FIG. 13 is a flowchart illustrating a process for utilizing the variable refresh rate tearing effect signal of FIG. 12, in accordance with an embodiment.

Turning now to a discussion of synchronization of variable refresh rate (VRR) display 20, FIG. 10 is a diagram illustrating timings 120 for display data writing and reading operations of VRR display 20 circuitry, in accordance with an embodiment. FIG. 11 is a flowchart illustrating a process for implementing a variable refresh rate. FIG. 12 is a flowchart illustrating a process for generating the TE signal (or other signal) for synchronization of VRR displays 21, in accordance with an embodiment. FIG. 13 is a flowchart illustrating a process for utilizing the TE signal 74 to synchronize timings of the SOC 70 with circuitry of a VRR display 20, in accordance with an embodiment. For clarity, FIGS. 10-13 will be discussed together.

Starting first with a discussion regarding operating in a variable refresh rate, FIG. 11 illustrates a process 160 for entry into a variable refresh rate mode. The process 160 determines whether or not new image data updates have been received by the display 20 from the SOC 70 during a vertical blanking period (determination block 162). If new image data updates are received, a normal operation may continue and/or if the display 20 is operating under a variable refresh rate (VRR) mode (e.g., at a lower operating refresh rate), the VRR mode may be exited (block 164). If, however, no new image updates are received, the vertical blanking (VBLNK) 122 may be extended (block 166).

For example, returning to FIG. 10, a frame buffer write operation 124 results in normal operation mode (e.g., as indicated by periods 126) and/or exiting 128 the VRR mode (e.g., cycles of display data reading and display data writing). However, when new data updates are not written during vertical blanking, such as at periods 130, the vertical blanking period may be extended until the next data update is written. Indeed, as illustrated, based upon the periods 130 where updates are not written, the vertical blanking periods 132 and 134 are extended until the VRR mode is exited 128 (e.g., at the next frame boundary (such as a 240 Hz frame boundary) after the writing of the data update is initiated).

As mentioned above, variable refresh rate displays 20 may provide certain operational efficiencies. For example, because pixel materials are able to sustain pixel output for previously outputted data, the VRR displays 20 may not need to continuously refresh the panel, when no new frame data is provided for presentation by the VRR displays 20. Thus, in contrast to the fixed frame rate mode of operating the display 20 discussed in FIGS. 8 and 9, the VRR displays 20 may maintain the pixel output without rescanning (e.g., re-reading the frame buffer).

Turning now to generation of the TE signal 74, FIG. 12 illustrates a process 180 for generating the TE signal 74. The display 20 may determine if scanning is complete (determination step 182). If scanning is not complete, the TE signal 74 is set to LOW (block 184). However, if the scanning is complete, the TE signal 74 is set to HIGH (block 186).

For example, returning to FIG. 10, during the scanning periods 136 (e.g., 60 Hz frame scanning rate), the TE signal 74 is set to LOW (e.g., at periods 138). When scanning is complete (e.g., at periods 140), the TE signal 74 is set HIGH (e.g., at periods 142). Accordingly, the TE signal 74 may be set based upon the setting of the vertical blanking 122.

During the scanning periods 136, the read operations 125 may be implemented. Accordingly, at periods 126, the read operations 125 may follow the write operations 124. Further, because the vertical blanking periods 132 and 134 are extended, the normal scanning periods are not implemented during the variable refresh periods, resulting in no read operations being performed at periods 135.

Once the TE signal 74 is generated, it may then be used to synchronize data writing from the SOC 70 to the circuitry of the display 20. FIG. 13 illustrates a process 200 for writing to the circuitry of the display 20 based upon the TE signal 74. The process 200 begins by determining if the TE level is HIGH (determination step 202). If the level is not HIGH (e.g., is LOW), the SOC 70 may not write (e.g., may delay writing) to the circuitry of the display 20 (block 204). However, if the level is HIGH, the SOC 70 may initiate data write operations (block 206).

For example, returning to FIG. 10, at time points 144, the data write operation 124 is initiated, because the TE signal 74 level is HIGH. However, the SOC 70 does not initiate data write operations 124 when the TE signal 74 level is LOW.

Figure 14:
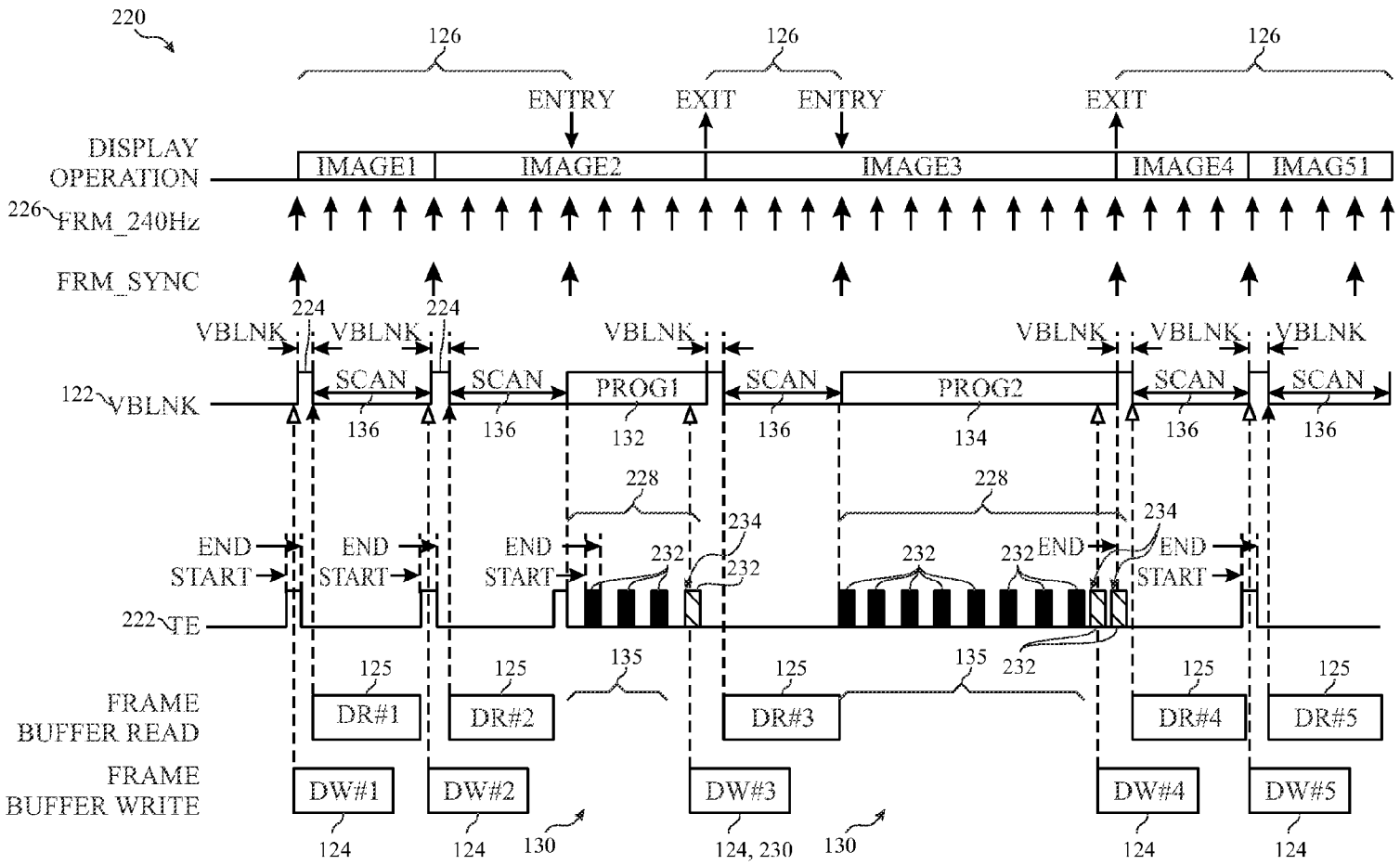
FIG. 14 is a diagram illustrating display data writing and reading of VRR display circuitry via the TE signal, in accordance with an embodiment.

FIG. 14 is a diagram of a time progression 220, illustrating display data writing operations and reading operations of circuitry of the VRR display 20, via the TE signal, in accordance with an embodiment. Similar to the embodiments of FIGS. 10 and 11, the vertical blanking periods 132 and 134 (e.g., the periods when vertical blanking signal 122 is HIGH) are extended when no new data is written (e.g., via write operations 124) to the display 20 (e.g., at periods 130). Accordingly, no read operations 125 are initiated during periods 135.

The vertical blanking periods (e.g., 132, 134, and 224) may trigger the TE signal 222 being set to high. For example, in the current embodiment, the TE signal 222 is provided as a leading offset with respect to the vertical blanking signal 122. In alternative embodiments, the TE signal 222 may be a lagging offset, etc.

During the extended vertical blanking periods (e.g., 132 and 134), a frame sync signal (e.g., the 240 Hz frame sync signal 226) may be incorporated to the TE signal 222. For example, as illustrated, at periods 228 associated with the extended vertical blanking periods 132 and 134, the frame sync signal 226 is applied to the TE signal 222. Accordingly, multiple rising edges of the TE signal 222 may be found during the periods 228. Thus, rapid write operation 124 triggering may still be facilitated for hosts 30 (e.g. SOCs 70) that rely on TE signal 222 edge triggering.

For example, if the host 30 is prepared to provide Image #3 data via write operation 230 during the extended vertical blanking period 132, the host 30 may rely on a rising edge of the TE signal 222 to provide an indication that data may be written to the display 20. Accordingly, the data write operation 230 may be synchronized using the incorporated frame sync signals 232. More specifically, upon detecting a rising edge 234 after the data is ready to be written from the host 30, the host 30 may be assured that the display is ready for a data write operation 124. Accordingly, the host 30 may provide the data via the operation 230. From there, the data may be read during the scanning periods 136.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

We claim:

1. An electronic device with a display, comprising:

variable refresh rate circuitry that enables the display to refresh a display panel at variable rates, the variable refresh rate circuitry configured to: when no new frame data is provided to the display, extend a vertical blanking period and reduce a refresh rate of the display until receipt of new frame data; and tearing effect correction circuitry that reduces artifacts caused by reading part of a first frame and part of a second frame onto the display at a common time, the tearing effect correction circuitry configured to:

generate a tearing effect signal that indicates when data is permitted to be provided to the display from a source of video data, wherein the tearing effect signal is selectively set to a first logical level at a first period of time and a second logical level at a second period of time, wherein the tearing effect signal accounts for extension of the vertical blanking period, by transitioning between the first logical level and the second logical level based on the vertical blanking period;

provide the tearing effect signal to the source of the video data that provides frame data to the electronic device; and upon the receipt of the new frame data, return to an un-extended vertical blanking period and display the frame data at the next frame boundary.

2. The electronic device of claim 1, wherein:

the tearing effect signal indicates that data is not permitted to be provided to the display when set to LOW; and the tearing effect signal indicates that data is permitted to be provided to the display when set to HIGH.

3. The electronic device of claim 1, wherein:

the tearing effect signal is set to the first logical level when scanning operations are performed by the electronic device and set to the second logical level when scanning operations are not being performed on the electronic device.

4. The electronic device of claim 3, wherein data read operations are implemented by the electronic device when the scanning operations are performed.

5. The electronic device of claim 1, wherein:

the tearing effect signal that is set to the first logical level and the second logical level based upon corresponding first logical level and second logical level settings of a vertical blanking signal indicative of the vertical blanking period.

6. The electronic device of claim 5, wherein:

the tearing effect signal comprises a leading offset with respect to the vertical blanking signal.

7. The electronic device of claim 5, wherein:

the tearing effect signal comprises a lagging offset with respect to the vertical blanking signal.

8. The electronic device of claim 5, wherein:

when the vertical blanking period is extended, a frame sync signal is incorporated into the tearing effect signal, providing a plurality of rising edges in the tearing effect signal during the vertical blanking period that is extended.

9. The electronic device of claim 8, wherein the frame sync signal comprises a 240 Hz frame sync signal.

10. A method of operating an electronic device with a display, comprising:

when no new frame data is provided to the display, extending a vertical blanking period and reducing a refresh rate of the electronic device until receipt of new frame data;

generating a tearing effect signal that is selectively set to a first logical level at a first period of time and a second logical level at a second period of time, wherein the tearing effect signal accounts for extension of the vertical blanking period, by transitioning between the first logical level and the second logical level based on the vertical blanking period, wherein the tearing effect signal provides an indication that data may be provided from a host electronic device, which sources video data, to the display whenever the tearing effect signal is set to the second logical level;

providing the tearing effect signal to the host electronic device that provides frame data to the display;

receiving the new data from the host electronic device based upon the tearing effect signal provided to the host electronic device; and upon the receipt of the new frame data, returning to an un-extended vertical blanking period and displaying the frame data at the next frame boundary.

11. The method of claim 10, further comprising:

setting the tearing effect signal to the first logical level when scanning operations are performed by the display; and setting to the second logical level when scanning operations are not being performed on the display.

12. The method of claim 11, further comprising:

implementing data read operations when the scanning operations are performed.

13. The method of claim 11, further comprising:

providing the tearing effect signal via a timing controller of the electronic device.

14. The method of claim 10, further comprising:

setting the tearing effect signal to the first logical level and the second logical level based upon a vertical blanking signal indicative of the vertical blanking period.

15. The method of claim 14, further comprising:

implementing a data write operation when the tearing effect signal is set to the second logical level, but not the first logical level.

16. The method of claim 14, further comprising:

setting the tearing effect signal by mirroring the vertical blanking signal.

17. A tangible, non-transitory, machine-readable storage medium storing one or more programs that are executable by one or more processors of an electronic device with a display, the one or more programs including instructions to:

when no new frame data is provided to the display, extend a vertical blanking period and reduce a refresh rate of the display until receipt of new frame data;

generate a tearing effect signal that is selectively set to a first logical level at a first period of time and a second logical level at a second period of time, wherein the tearing effect signal provides an indication that data may be provided from a host electronic device to the display whenever the tearing effect signal is set to the second logical level, wherein the tearing effect signal accounts for extension of the vertical blanking period, by transitioning between the first logical level and the second logical level based on the vertical blanking period;

provide the tearing effect signal to the host electronic device that provides frame data to the display;

receive the new data from the host electronic device based upon the tearing effect signal provided to the host electronic device; and upon the receipt of the new frame data, return to an un-extended vertical blanking period and displaying the frame data at next frame boundary.

18. The machine-readable storage medium of claim 17, further comprising instructions to:

set the tearing effect signal to the first logical level when scanning operations are performed by the display; and set to the second logical level when scanning operations are not being performed on the display.

19. The machine-readable storage medium of claim 17, further comprising instructions to:

set the tearing effect signal to either the first logical level or the second logical level, by mirroring a vertical blanking signal indicative of the vertical blanking period.

20. The machine-readable storage medium of claim 17, further comprising instructions to:

perform data write operations when the tearing effect signal is set to the second logical level, but not the first logical level.

* * * * *